US006076745A

United States Patent [19]

Primdahl

[11] Patent Number: 6,076,745

[45] Date of Patent: Jun. 20, 2000

[54] SWIRLING-FLOW BURNER

[75] Inventor: Ivar Ivarsen Primdahl, Copenhagen, Denmark

[73] Assignee: Haldor Topsoe A/S, Lyngby, Denmark

[21] Appl. No.: 09/071,679

[22] Filed: May 1, 1998

[30] Foreign Application Priority Data

May 1, 1997 [DK] Denmark ..... 0495/97

[51] Int. Cl.[7] ..... B05B 15/00

[52] U.S. Cl. ..... 239/132.5; 239/403

[58] Field of Search ..... 239/403–406, 239/132.3, 132.5

[56] References Cited

U.S. PATENT DOCUMENTS

| | | | |
|---|---|---|---|
| 2,624,624 | 1/1953 | Kirschbaum | 239/403 |
| 2,636,778 | 4/1953 | Michelsen | 239/403 |
| 2,701,164 | 2/1955 | Purchas, Jr. et al. | 239/404 |
| 2,755,134 | 7/1956 | Eck et al. | 239/403 |
| 3,474,970 | 10/1969 | Simmons et al. | 239/404 |
| 4,216,908 | 8/1980 | Sakurai et al. | 239/132.3 |
| 4,773,596 | 9/1988 | Wright et al. | 239/400 |
| 4,842,197 | 6/1989 | Simon et al. | 239/403 |
| 5,713,205 | 2/1998 | Sciocchetti et al. | 239/403 |

*Primary Examiner*—Andres Kashnikow
*Assistant Examiner*—Dinh Q. Nguyen
*Attorney, Agent, or Firm*—Ostrolenk, Faber, Gerb & Soffen, LLP

[57] ABSTRACT

A swirling-flow burner includes a burner tube and an oxidizer supply tube concentric with and spaced from the burner tube to define an annular fuel gas conduit between the tubes. A fuel gas injector is connected to the outlet end of the fuel gas conduit has a substantially U-shaped cross-section around a common axis of symmetry of the burner tube and the injector, and also has an annular outlet directed inwardly towards the axis and a gas mixing zone. A oxidizer injector is connected to the outlet end of the oxidizer supply tube and has an axis of symmetry common with the fuel gas injector. The outlet of the oxidizer injector is directed towards the gas mixing zone. A static swirler is provided in the oxidizer injector for producing a swirling movement of the oxidizer around the axis before the oxidizer is discharged from the oxidizer injector. The static swirler includes a partition dividing the flow of oxidizer between an upstream and a downstream section and is provided with at least one passageway for the passage of the oxidizer from the upstream to the downstream section, where the passageway is designed to change the flow direction of the oxidizer from a direction parallel with the axis of symmetry upstream of the partition to a direction transversely to the axis and tangentially in relation to the axis downstream of the partition, so as to form a rotating flow of oxidizer around the axis.

13 Claims, 2 Drawing Sheets

SWIRLING-FLOW BURNER

BACKGROUND OF THE INVENTION

The invention concerns a swirling-flow burner comprising a burner tube and an oxidizer supply tube concentric with and spaced from the burner tube, defining an annular fuel gas conduit between the tubes, the oxidizer supply tube and the fuel gas conduit having separate inlet ends and separate outlet ends, a fuel gas injector connected to the outlet end of the fuel gas conduit, which fuel gas injector having a substantially U-shaped cross section around a common axis of symmetry of the burner tube and the injector and having an annular outlet directed inwardly towards the axis and a gas mixing zone, an oxidizer injector connected to the outlet end of the oxidizer supply tube and having an axis of symmetry common with the fuel gas injector, wherein the outlet of the oxidizer injector is directed towards the gas mixing zone, further comprising static swirler means provided in the oxidizer injector for producing a swirling movement of the oxidizer around the axis before the oxidizer is discharged from the oxidizer injector.

A burner for use in gas-fired catalytic reactors is disclosed in EP B1 545,440. The main field of application of the known burner is the production of hydrogen and carbon monoxide process gas by primary and secondary steam reforming or by autothermal catalytic reforming of a hydrocarbon fuel, where the problem is to produce a process gas with a low carbon soot content as the process has to take place with a substoichiometric oxidizer-supply. According to the prior art, this is counteracted by providing multiple mixing points for the fuel gas and the oxidizer by generating a central swirling flow of oxidizer that is guided to the mixing zone, where the fuel is supplied peripherally to the oxidizer flow. The swirling or rotating movement of the oxidizer is generated by pitched blades in the swirler.

Furthermore, as the combustion temperature is high, often above 1000° C., there is a risk for overheating of the burner surface close to the combustion zone, when designing the burner for recirculation of hot gases for mixing purposes towards the burner surfaces. According to EP B1 545,440, the design of the burner directs the flow of combustion products away from the burner along the central axis causing the recirculation of the combustion products to take place at the cooler periphery of the combustion zone, whereby the gases are cooled before they reach the burner face and are mixed with and reheated by the central flow away from the burner.

As steam is usually supplied to the hydrocarbon fuel for moderating the flame temperature and enhancing hydrocarbon conversion, this also has the effect of suppressing soot formation. The swirler incorporated in the burner according to the known art has a mixing effect depending on the pitch angle of the blades of the swirler, and experiments have shown that an increasing pitch angle makes it possible to feed with a lower steam to hydrocarbon ratio, hereafter referred to as S/C ratio. While a blade angle of e.g. 30° results in a soot limit at a S/C ratio of 0.9, a blade angle of 60° lowers the soot limit at a S/C ratio of 0.6. It is desirable to lower the soot limit further, but physical conditions limit the blade pitch angles to about 60 to 75°.

SUMMARY OF THE INVENTION

It is a general object of the invention to increase the mixing effect of the oxidizer swirler means in a swirling-flow burner.

It is a further object of the invention to lower the tendency to carbon soot generation of effluent gas produced by a swirling-flow burner with sub-stoichiometric oxidizer supply.

These and other objects are achieved in a swirling-flow burner in accordance with the present invention which comprises static swirler means consisting of a partition dividing the flow of oxidizer between an upstream and a downstream section and provided with at least one passageway for the passage of the oxidizer from the upstream to the downstream section, wherein the passageway is designed to provide a change of the flow direction of oxidizer from a direction parallel with the axis of symmetry upstream of the partition to a direction transversely thereto and tangentially in relation to the axis downstream of the partition, thereby forming a rotating flow of oxidizer around the axis.

By the invention it is possible to change the direction of the oxidizer flow up to 90° in relation to the original direction, while the tangentially directed passageway causes a swirling motion of the oxidizer. Thereby, an increased rotation of the oxidizer is achieved before it enters the mixing zone, upon passing through the outlet, i.e. along the axis, and thus, an increased mutual mixing of fuel and oxidizer occurs as a non-rotating radial stream of fuel gas hits the rotating oxidizer gas and causes turbulence between the gases.

In a preferred embodiment according to the invention, the fuel gas injector is provided with a substantially planar internal surface surrounding the fuel gas outlet for directing the fuel gas flow mainly perpendicularly against the flow of oxidizer in the gas mixing zone. The fuel gas is forced radially towards the oxidizer flow in the center, while forming a collar-like stream without any velocity component parallel with the oxidizer. As the fuel gas and the oxidizer meet without any common motion components, a maximum of mixing effect is achieved.

In another preferred embodiment according to the invention, the partition is substantially shaped as an inverted cup with the top pointing against the flow direction of oxidizer and having an annular wall section extending along the inside of the oxidizer supply tube, where the passageway for the oxidizer is provided in the wall section. The partition may then be designed rather simply as an insert sealing the end of the oxidizer supply tube, except for one or more machined passageways for oxidizer flow. Thereby, the oxidizer flow may pass between the oxidizer tube and the wall section until it is turned transversely to the original flow direction by one or more passageways in the partition.

In order to ensure a symmetric flow upstream and downstream of the partition while minimizing pressure loss caused by turbulence, there are preferably 2–4 passageways.

The wall section of the partition will typically have a cylindrical outer surface, which is a simple and cost-saving design.

In a further embodiment according to the invention, a swirling chamber with an annular cross-section around the axis and with a larger diameter than the oxidizer outlet is provided in the oxidizer injector between the partition and the oxidizer outlet and wherein the surface section constituting the transition between the swirling chamber and the oxidizer outlet is rounded. The swirling chamber enhances the rotational movement of the oxidizer before leaving it through the outlet, and the rounded transition keeps turbulence low, thereby also avoiding a disturbance in the rotation.

When the outlet of the oxidizer injector is provided with an annular lip extending into the gas mixing zone, the mixing point: of fuel and oxidizer is moved away from the burner face, especially when designing the lip with a very sharp angle.

BRIEF DESCRIPTION OF THE DRAWINGS

Preferred embodiments according to the invention are described in detail in the following with reference to the drawings, where.

DESCRIPTION OF EMBODIMENTS

In a first, preferred embodiment according to the invention, a burner for gaseous fuel comprises an outer burner tube 1, in which an oxidizer supply tube 2 of smaller diameter is concentrically provided. Burner tube 1 and oxidizer tube 2 define a duct 3 therebetween for the supply of fuel gas. The oxidizer tube defines a duct 4 for the supply of oxidizer. Ducts 3 and 4 have separate, not shown inlets.

Figure 1:
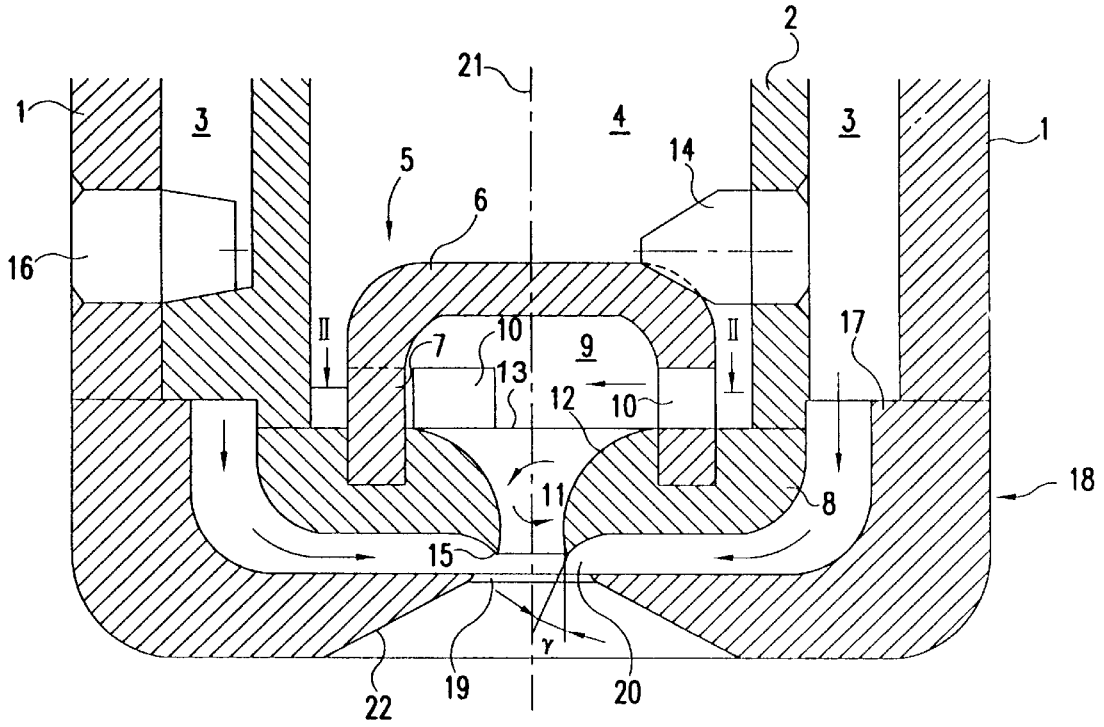
FIG. 1 shows an elevated section of a preferred embodiment of the burner according to the invention.
Figure 2:
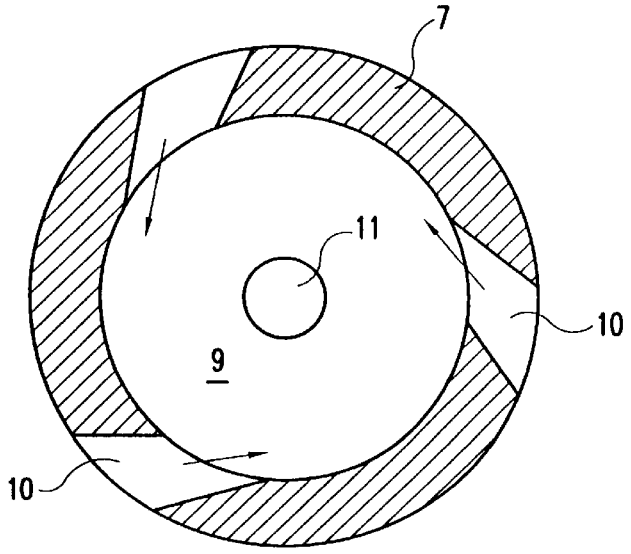
FIG. 2 shows a section along the line II—II in FIG. 1.

The outlet of oxidizer tube 2 is furnished with an oxidizer injector generally designated 5, comprising a partition 6 shaped as an inverted cup and provided with a cylindrical skirt 7. Other embodiments may comprise dome-shaped, tapered, or disc-shaped partitions. The rim of skirt 7 is embedded in an end piece 8 welded onto the end of tube 2, thereby defining a swirling-chamber 9 between parts 6, 7 and 8. Partition 6 is kept in place with a stud 14 screwed and welded into the wall of tube 2, but other embodiments without this feature are possible, e.g. with the partition welded to the end piece 8. As shown in FIGS. 1 and 2, partition 6 has three passageways for the oxidizer formed as slits 10 machined into skirt 7. The passageways may have other geometrical shapes, e.g. as round holes, and may be more or less in number. Slits 10 are directed tangentially in relation to the cylindrical inwardly facing side of partition 6. Centrally in end piece 8 oxidizer injector outlet 11 is placed, with a rounded transition 12 for reducing turbulence between outlet 11 and the flat upper side 13 of end piece 8, making outlet 11 nearly funnel-shaped. An annular lip 15 surrounding outlet 11 projects from the otherwise flat outer surface of end piece 8. Lip 15 has a tip angle $\gamma$, which is preferably in the range of 15–40°.

A stud 16 mounted in burner tube 1 keeps oxidizer tube 2 fixed against a projection 17 at the bottom end of tube 1, but other means of fastening tube 2 are possible. Fuel gas supply duct 3 is connected to a generally U-shaped fuel injector 18, wherein the bottom of the U is generally planar with a centrally provided circular aperture 19 concentric with axis 21 of symmetry of tubes 1, 2 and end piece 8. Outlet 20 of the fuel gas tube is thereby defined as an annular aperture between the inner edge of aperture 19 and lip 15 on end piece 8. A gas mixing zone is thus created between outlets 11 and 20, and from here the mixing zone extends further away from the burner along axis 21. The bottom of fuel gas injector 18 is provided at the outer side with an obtuse-angled conical surface 22 surrounding aperture 19 for avoiding contact with the hot combustion products, which otherwise may overheat injector 18.

Figure 3:
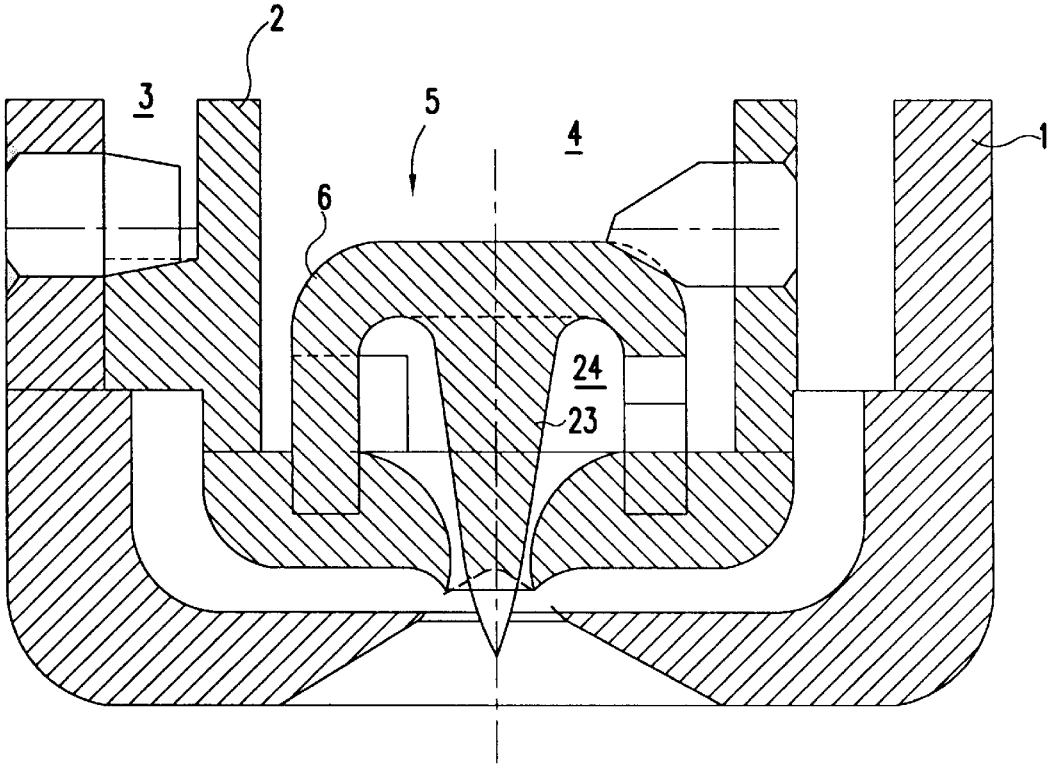
FIG. 3 shows an elevated section of a second embodiment according to the invention.

Another embodiment according to the invention as shown on FIG. 3 features common details with the first embodiment described above, except that the oxidizer injector is provided with an elongated bluff body 23 shaped like an icicle. Body 23 is fastened to or is integrated with the top of partition 6 and stretches through the oxidizer outlet 11 and aperture 19. The presence of the bluff body 23 provides an annular space 24 within the oxidizer injector 5 and at the top of the gas mixing zone and eliminates immobile or slow-moving central parts of oxidizer gas.

Fuel gas containing hydrocarbon compounds, and steam, and possibly carbon monoxide from a previous process step, is supplied with high pressure through duct 3 and flows through fuel injector 18 towards outlet 20, the last part of the flow being directed radially and collar-like towards axis 21. The straight flow of oxidizer, which may be air, oxygen, or oxygen-enriched air, supplied to duct 4, is turned 90° as it reaches end piece 8 between partition 6 and tube 2 and is forced through slits 10. Because of the tangential direction of slits 10, the substreams of oxidizer gas entering swirling chamber 9 induce a rotational movement of the gas inside chamber 9 with a rather small component of motion, or none at all, in the axial direction. As the oxidizer is discharged through outlet 11, it has still a rotating or swirling movement when it reaches the gas mixing zone and is hit by the transversely directed flow of fuel gas through outlet 20. As the oxidizer and the fuel flows by lip 15, the geometry and tip angle of lip 15 cause the two gas streams to flow together at a distance from the outlets thereby moving the hot combustion zone away from the burner. Because of the intense rotational movement of the oxidizer, a better mixing of fuel and oxidizer in the mixing zone is obtained, thereby lowering the tendency of this sub-stoichiometric process to produce carbon soot. The mixing effect is enhanced by the substantially perpendicular injection of the fuel gas towards the axially moving oxidizer.

The burner according to the invention may be used for other combustion purposes than indicated in the above.

What is claimed is:

1. A swirling-flow burner comprising:

a burner tube and an oxidizer supply tube concentric with and spaced from the burner tube, defining an annular fuel gas conduit between the tubes, the oxidizer supply tube and the fuel gas conduit having separate inlet ends and separate outlets ends:

a fuel gas injector connected to the outlet end of the fuel gas conduit, the fuel gas injector having a substantially U-shaped cross section around a common axis of symmetry of the burner tube and the injector and having an annular outlet directed inwardly towards the axis and a gas mixing zone;

an oxidizer injector connected to the outlet end of the oxidizer supply tube and having an axis of symmetry common with the fuel gas injector, wherein the outlet of the oxidizer injector as directed towards the gas mixing zone; and a static swirler provided in the oxidizer injector for producing a swirling movement of the oxidizer around the axis before the oxidizer is discharged from the oxidizer injector, wherein the static swirler includes a partition dividing the flow of oxidizer into an upstream and a downstream section, the partition being provided with at least one passageway for the passage of the oxidizer from the upstream to the downstream section, wherein the passageway forces the flow direction of oxidizer from a direction parallel with the axis of symmetry upstream of the partition to a direction transversely thereto and tangentially in relation to the axis downstream of the partition, thereby forming a rotating flow of oxidizer around the axis, and wherein the fuel gas injector has a substantially planar internal surface surrounding the fuel gas outlet for directing a fuel gas flow mainly perpendicularly against the flow of oxidizer in the gas mixing zone.

2. A swirling-flow burner according to claim 1, wherein the partition is substantially shaped as an inverted cup with a top surface thereof pointed against the direction of flow of oxidizer and having an annular wall section extending along the inside of the oxidizer supply tube, and wherein the passageway for the oxidizer is provided in the wall section.

3. A swirling-flow burner according to claim 2, wherein the partition is provided with between three and ten passageways.

4. A swirling-flow burner according to claim 3, wherein the static swirler includes a swirling chamber of annular cross-section around the axis and with greater diameter than the oxidizer outlet, the swirling chamber being provided in the oxidizer injection between the partition and the oxidizer outlet, and wherein a surface section constituting a transition between the swirling chamber and the oxidizer outlet is rounded.

5. A swirling-flow burner according to claim 3, wherein the outlet of the oxidizer injector is provided with an annular lip extending into the gas mixing zone.

6. A swirling-flow burner according to claim 2, wherein the wall section has a cylindrical outer surface.

7. A swirling-flow burner according to claim 6, wherein the static swirler includes a swirling chamber of annular cross-section around the axis and with greater diameter than the oxidizer outlet, the swirling chamber being provided in the oxidizer injection between the partition and the oxidizer outlet, and wherein a surface section constituting a transition between the swirling chamber and the oxidizer outlet is rounded.

8. A swirling-flow burner according to claim 6, wherein the outlet of the oxidizer injector is provided with an annular lip extending into the gas mixing zone.

9. A swirling-flow burner according to claim 2, wherein the static swirler includes a swirling chamber of annular cross-section around the axis and with greater diameter than the oxidizer outlet, the swirling chamber being provided in the oxidizer injection between the partition and the oxidizer outlet, and wherein a surface section constituting a transition between the swirling chamber and the oxidizer outlet is rounded.

10. A swirling-flow burner according to claim 2, wherein the outlet of the oxidizer injector is provided with an annular lip extending into the gas mixing zone.

11. A swirling-flow burner according to claim 1, wherein the static swirler includes a swirling chamber of annular cross-section around the axis and with greater diameter than the oxidizer outlet, the swirling chamber being provided in the oxidizer injection between the partition and the oxidizer outlet, and wherein a surface section constituting a transition between the swirling chamber and the oxidizer outlet is rounded.

12. A swirling-flow burner according to claim 11, wherein the outlet of the oxidizer injector is provided with an annular lip extending into the gas mixing zone.

13. A swirling-flow burner according to claim 1, wherein the outlet of the oxidizer injector is provided with an annular lip extending into the gas mixing zone.

* * * * *